US008225494B2

(12) United States Patent
Lauzier et al.

(10) Patent No.: US 8,225,494 B2
(45) Date of Patent: Jul. 24, 2012

(54) RECONFIGURABLE PALLET WITH ERROR PROOFING

(75) Inventors: Nicolas Lauzier, Ste-Flavie (CA); Robin Stevenson, Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1128 days.

(21) Appl. No.: 12/107,363

(22) Filed: Apr. 22, 2008

(65) Prior Publication Data

US 2009/0260549 A1 Oct. 22, 2009

(51) Int. Cl.
*B23P 19/00* (2006.01)

(52) U.S. Cl. ..... 29/714; 29/799; 29/712; 29/713; 29/401.1; 29/709; 248/346.02; 248/346.03; 269/289 R; 108/91; 108/55.3; 108/54.1; 414/807

(58) Field of Classification Search ..... 29/401.1, 29/559, 759, 760, 772, 799, 281.1, 281.6, 29/703, 709, 712, 713, 714; 248/346.02, 248/346.03; 269/289 R; 108/91, 55.3, 54.1; 414/807

See application file for complete search history.

(56) References Cited

U.S. PATENT DOCUMENTS

| | | | | | |
|---|---|---|---|---|---|
| 3,622,114 | A * | 11/1971 | McIntire, Jr. | ..... | 248/346.02 |
| 3,711,929 | A * | 1/1973 | Blakey et al. | ..... | 29/407.05 |
| 3,753,407 | A * | 8/1973 | Tilseth | ..... | 108/53.3 |
| 4,015,710 | A * | 4/1977 | Biggs | ..... | 206/386 |
| 4,732,528 | A * | 3/1988 | Good | ..... | 414/802 |
| 4,774,892 | A * | 10/1988 | Ballard et al. | ..... | 108/55.3 |
| 4,896,612 | A * | 1/1990 | Salloum | ..... | 108/55.3 |
| 5,026,033 | A * | 6/1991 | Roxy | ..... | 269/45 |
| 5,107,599 | A * | 4/1992 | Marincic et al. | ..... | 33/573 |
| 5,497,708 | A * | 3/1996 | Jeruzal | ..... | 108/54.1 |
| 5,722,330 | A * | 3/1998 | Staggers | ..... | 108/55.3 |
| 5,809,906 | A * | 9/1998 | Janek | ..... | 108/57.15 |
| 5,842,424 | A * | 12/1998 | Prevot et al. | ..... | 108/54.1 |
| 5,918,551 | A * | 7/1999 | Liu | ..... | 108/55.1 |
| 5,970,885 | A * | 10/1999 | Polando | ..... | 108/55.3 |
| 6,644,637 | B1 * | 11/2003 | Shen et al. | ..... | 269/152 |
| 7,055,679 | B2 * | 6/2006 | Shen et al. | ..... | 198/867.08 |
| 7,997,553 | B2 * | 8/2011 | Sloan et al. | ..... | 248/346.02 |
| 8,025,277 | B2 * | 9/2011 | Lin et al. | ..... | 269/55 |
| 8,028,631 | B2 * | 10/2011 | Lauzier et al. | ..... | 108/55.3 |
| 8,033,226 | B2 * | 10/2011 | Lauzier et al. | ..... | 108/55.3 |
| 8,033,227 | B2 * | 10/2011 | Lauzier et al. | ..... | 108/55.3 |

FOREIGN PATENT DOCUMENTS

WO WO 2006076545 A2 * 7/2006

* cited by examiner

*Primary Examiner* — David Bryant
*Assistant Examiner* — Bayan Salone
(74) *Attorney, Agent, or Firm* — Quinn Law Group, PLLC

(57) ABSTRACT

A pallet includes a platform and a plurality of support assemblies located at multiple positions on the platform. One support assembly is associated with each location of the component to be supported. Each support assembly has a linkage assembly to support and enable movement of a support element. The support assemblies also each include multiple bases secured to the platform, to position the support element in a desired location for each version of a component. An alignment mechanism on each base allows for rotational alignment of the support element relative to the pallet. An error proofing mechanism compares the selected location of the support element for each of the plurality of support assemblies and provides confirmation and correction information as required.

6 Claims, 11 Drawing Sheets

RECONFIGURABLE PALLET WITH ERROR PROOFING

TECHNICAL FIELD

The present invention relates generally to pallets for assembly plants, and more specifically to a reconfigurable pallet.

BACKGROUND OF THE INVENTION

During assembly of vehicles in an assembly plant individual components must be supported prior to installation in the vehicle. In the case of heavy or bulky components it may be necessary or desirable to support these components in a specific configuration which facilitates installation of the component into the vehicle. For example, it may be desirable to support the component in an orientation which corresponds to its in-vehicle orientation and in a manner which enables access to locations, such as boltholes, used to attach the component to the vehicle.

An example of this is a vehicle engine or powertrain (i.e. engine plus transmission), where engine and/or powertrain specific support structures are used for the purpose of presenting the engine or powertrain to the vehicle body in a manner which facilitates attachment of the engine or powertrain to the vehicle body.

Commonly, customers may be offered various hardware options, such as engines or powertrains, with a specific vehicle body. Hence, to meet the need described above, multiple support structures must be employed each of which will be specific to a single hardware option or component version and which will be incapable of being used for other options. Frequently, for convenience and to ensure their strength and rigidity, these support structures are mounted on a platform. Together the support structure and the platform to which is attached constitute a pallet. As a result, a unique pallet is required for each version of the component associated with the assembly line.

SUMMARY OF THE INVENTION

A pallet that can be reconfigured to support multiple versions of a component associated with an assembly line is desired.

A pallet of the present invention includes a platform and a plurality of support assemblies located at multiple positions on the platform. One support assembly is associated with each support location of the component. The support assemblies each include a support element and a plurality of bases, one base for each version of the component to be supported.

The support element is positioned on the desired base. An interface on the base for receiving a footing of the support element places the support element in the desired location. The support element includes a locator. Once positioned on the base, the locator corresponds to a predetermined location on the component which has a mount for alignment. The height of the interface places the locator at the appropriate height for the mount of that version of the component.

The support element may be constrained by a linkage assembly. The linkage assembly has a foundation secured to the platform. A first arm is rotatably connected to the foundation with a first joint and a second arm is rotatably connected to the first arm with a second joint. An aperture for receiving the support element is defined by the second arm.

An alignment mechanism is associated with each base. An extension protruding upwards from the base is received within a recess defined by the support element. The support element is positioned such that the recess is located above the extension. The support element is then rotated until an elongated portion is aligned with a planar wall on the base. Once aligned the support element can be moved vertically to seat the footing on the base. To configure the support assembly for another version of the component the footing is moved from the interface of the current base to the interface of another. The support element is rotated until the elongated portion and the planar wall of that base are in alignment.

An error proofing mechanism is provided for each support element and includes a relay mechanism associated with each base. Once in the support element is in the proper alignment and fully seated on the desired base the elongated portion of the footing contacts a contact surface on the relay mechanism. A signal is sent from the relay mechanism to a control unit which confirms the support element is mounted on the correct base and provides an indicator showing confirmation.

The support assemblies allow the pallet to quickly and easily be reconfigured by a single operator. Associating an alignment mechanism with each base allows each support element to be rotationally positioned relative to the pallet providing precise mounting locations. Thus, the pallet accommodates relatively minimal lateral differences between desired mounting locations of different versions of the component. Providing a reconfigurable pallet to be used with multiple versions of a component on an assembly line reduces costs.

The invention also includes an improved method for reconfiguring a pallet. The method comprises positioning a support element above one of a plurality of bases via movement of a linkage assembly, rotating the support element until an elongated portion of the support element is aligned with a planar wall of the one of the plurality of bases, and sliding the support element relative to the linkage assembly to mount the support element on the one of the plurality of bases.

The above features and advantages, and other features and advantages of the present invention will be readily apparent from the following detailed description of the preferred embodiments and best modes for carrying out the present invention when taken in connection with the accompanying drawings.

Figure 6C:
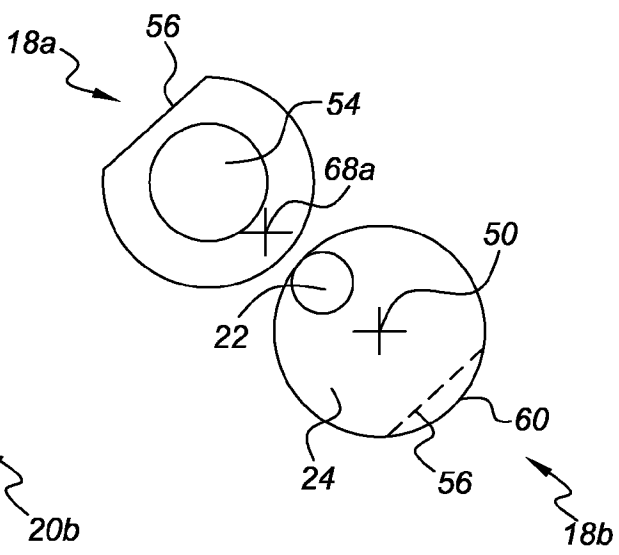

FIG. **6*a*** is a schematic view illustrating alignment of multiple bases of the support assembly for the pallet of the present invention;

FIG. **6*b* is a schematic view illustrating alignment of one base and the support element with another base of the support assembly for the pallet of the present invention; and FIG. 6*c*** is a schematic view illustrating alignment of one base with another base and the support element of the support assembly for the pallet of the present invention.

Figure 7:
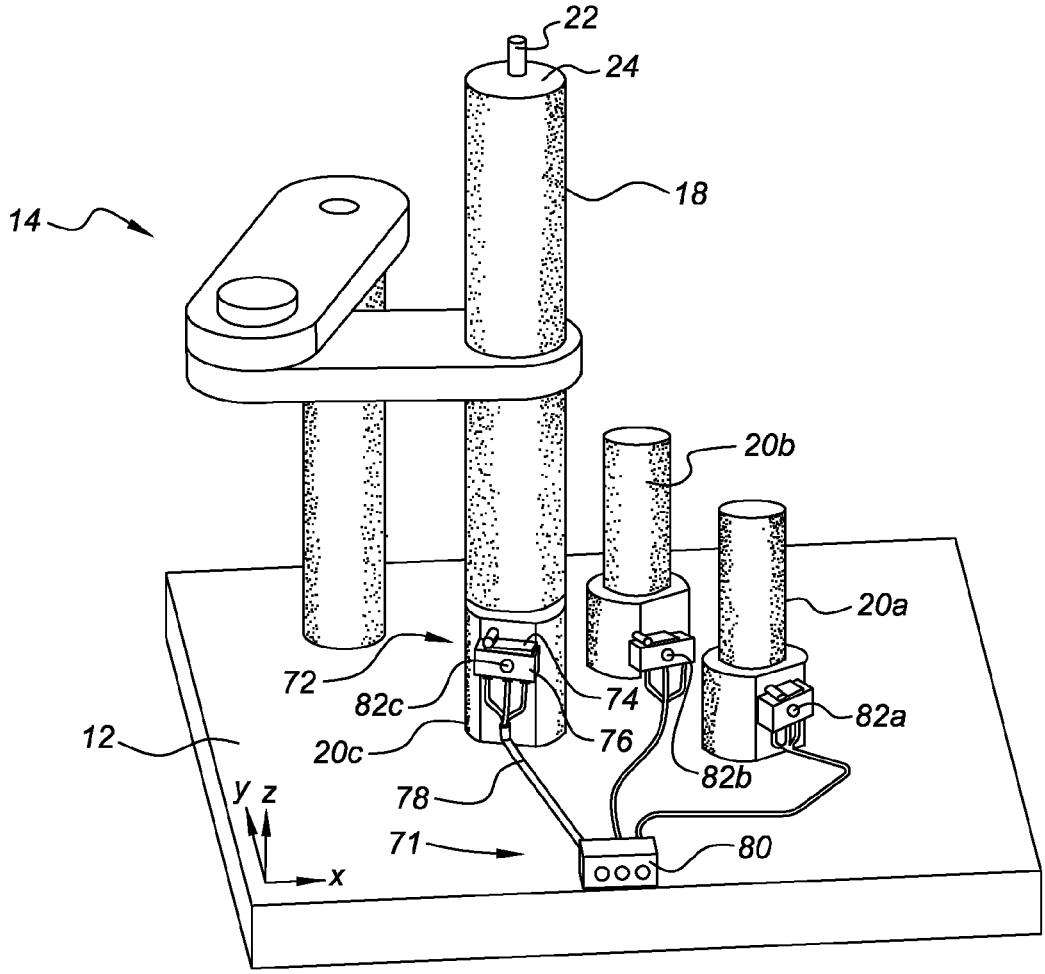
Figure 8B:
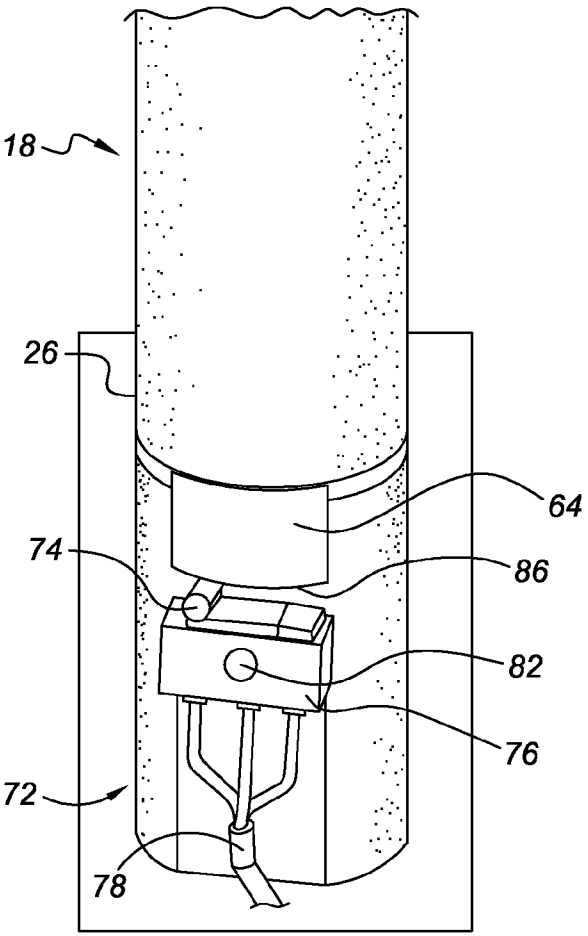
Figure 8A:
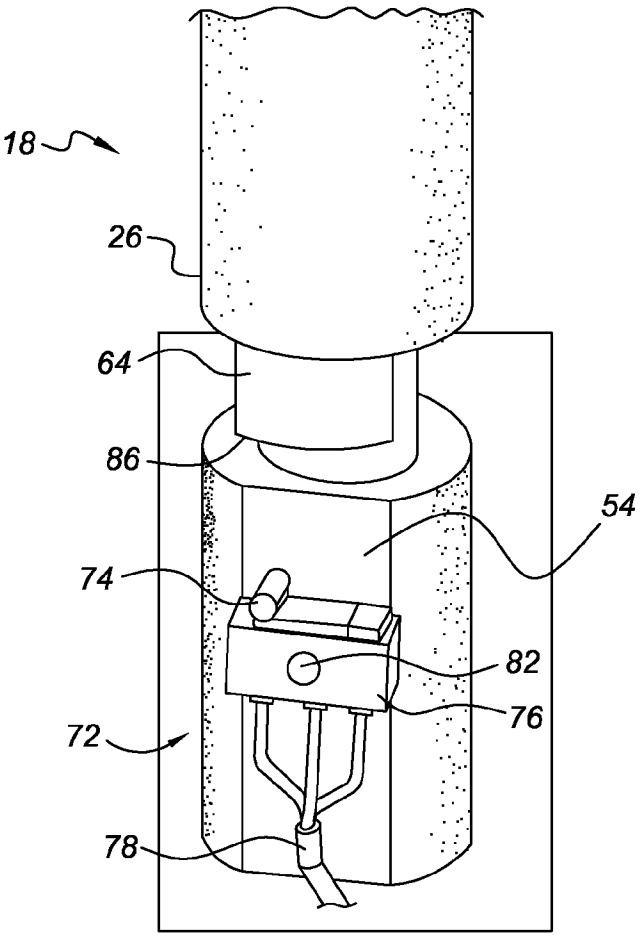
Figure 9:
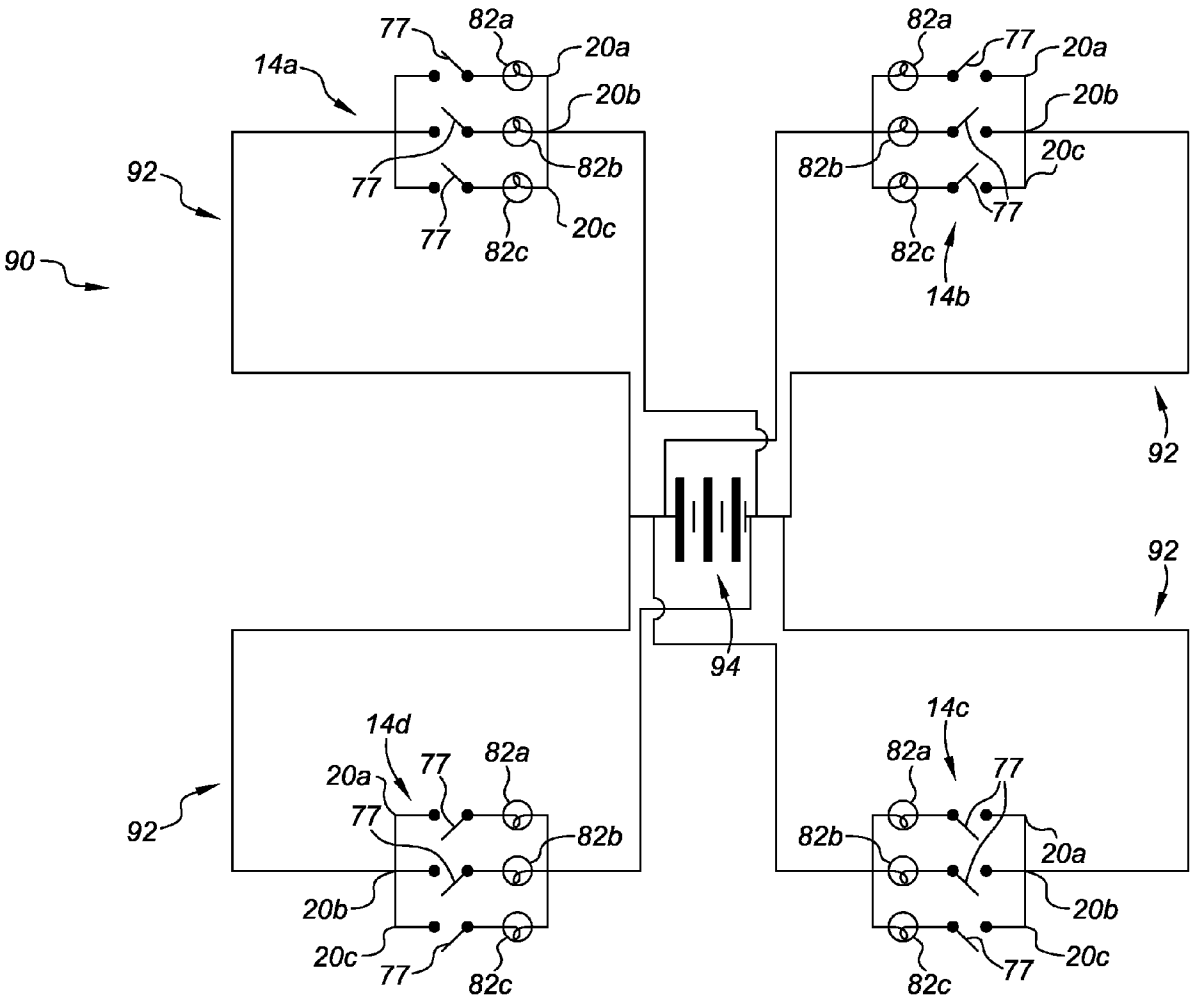
Figure 10:
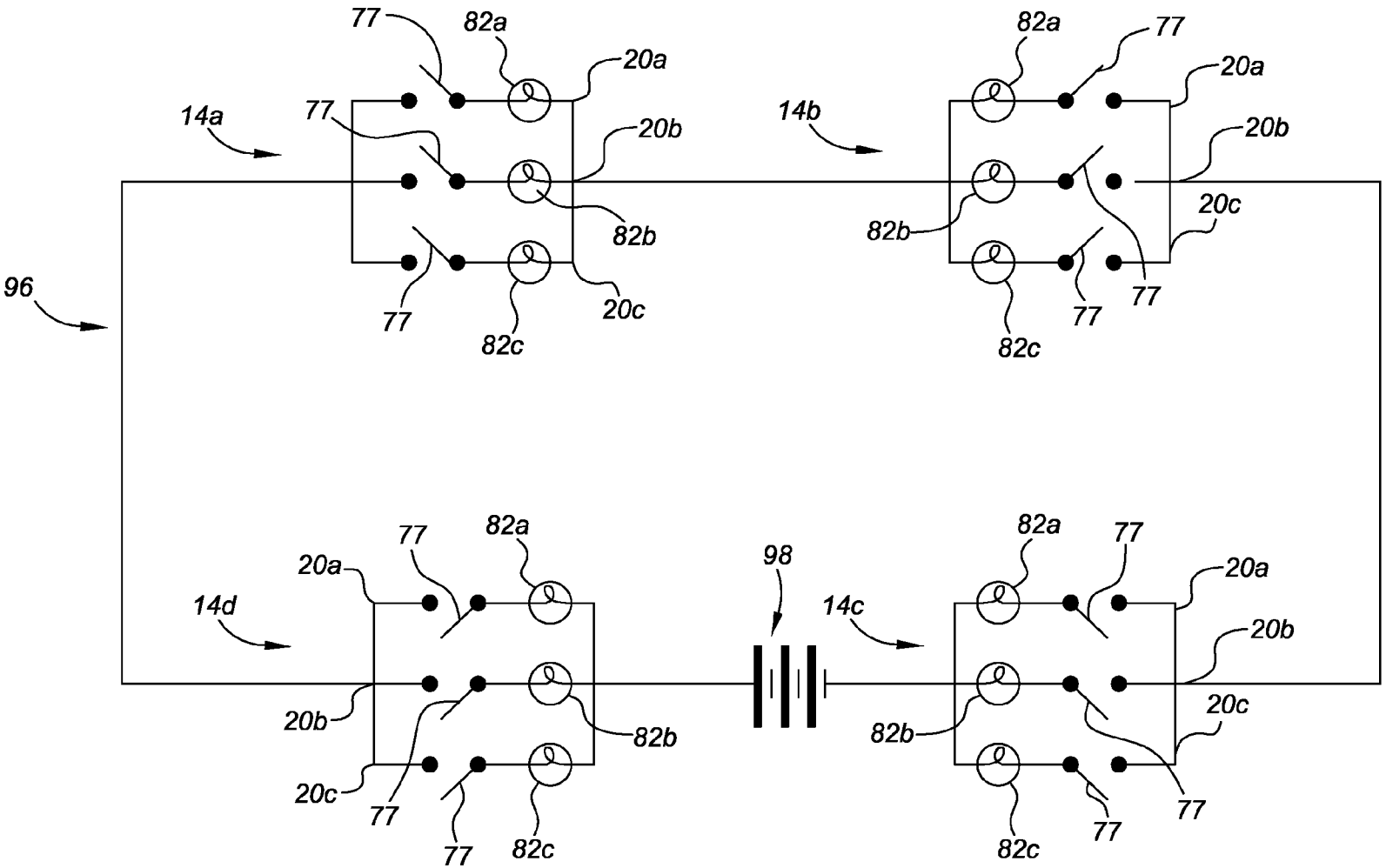
Figure 11:
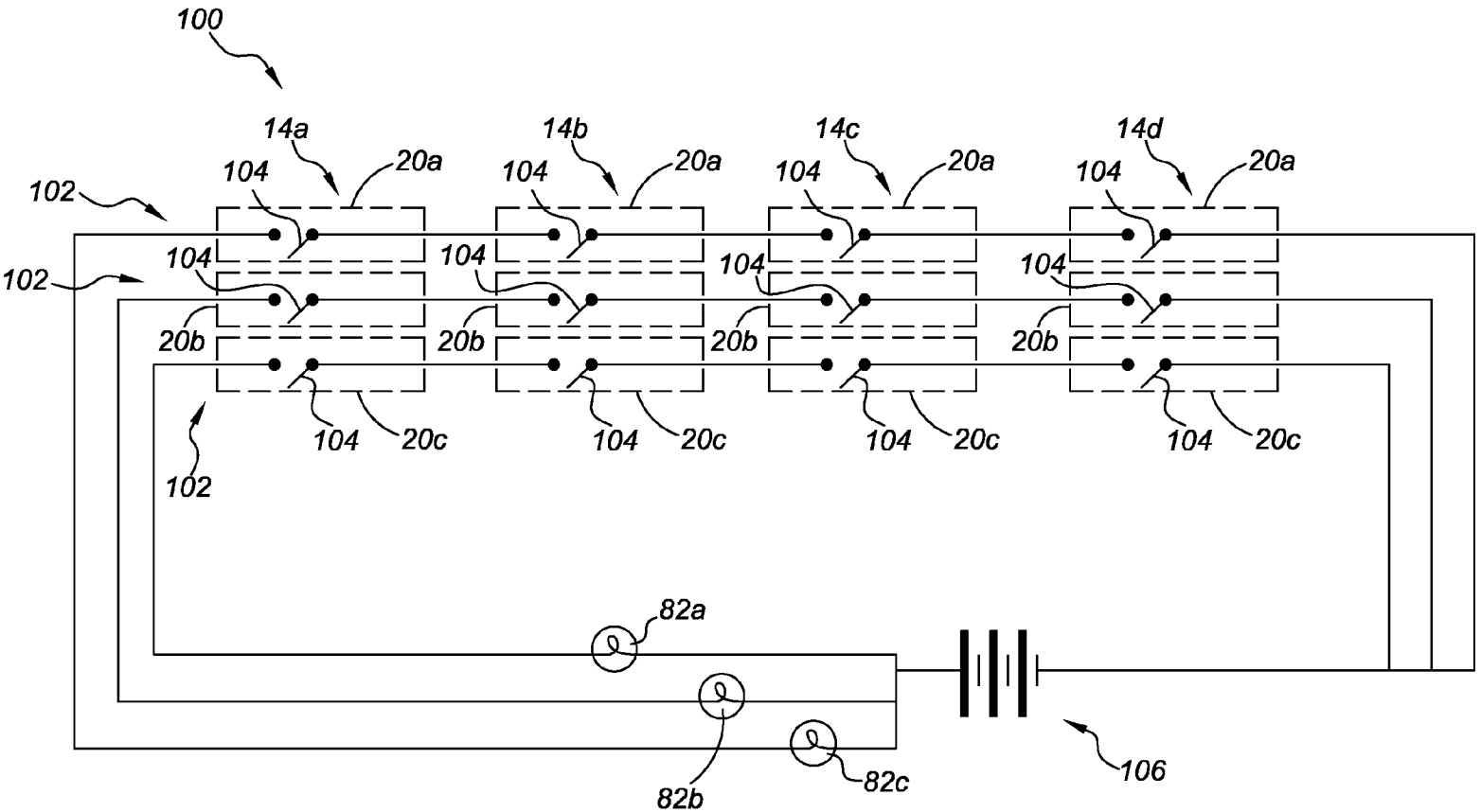
Figure 12:
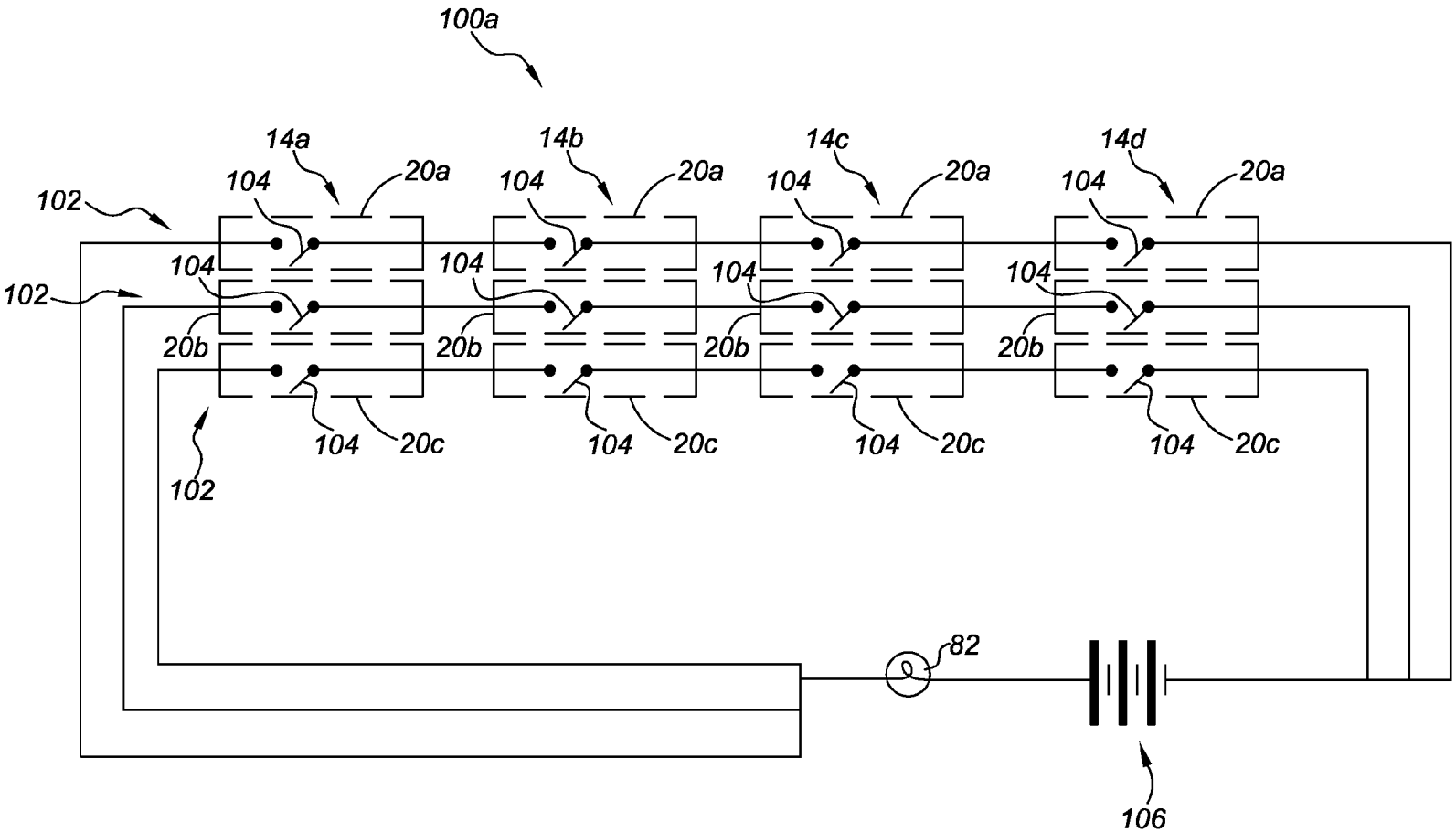

FIG. 7 is an enlarged perspective view of one support assembly for the pallet illustrating the error proofing mechanism of the present invention;

FIG. 8*a* is an enlarged perspective view another illustrating alignment of the error proofing mechanism of the present invention;

FIG. 8*b* is an enlarged perspective view illustrating alignment of the error proofing mechanism just prior to contact of the support element and the base;

FIG. 9 illustrates an electrical circuit illustrating an embodiment of the error proofing mechanism for the pallet of the present invention;

FIG. 10 illustrates an electrical circuit which provides information of another embodiment of the error proofing mechanism for the pallet of the present invention;

FIG. 11 illustrates an electrical circuit which provides information of a third error proofing mechanism for the pallet of the present invention; and FIG. 12 illustrates an electrical circuit which provides information of another embodiment of the error proofing mechanism for the pallet of the present invention.

DESCRIPTION OF THE PREFERRED EMBODIMENTS

Figure 1:
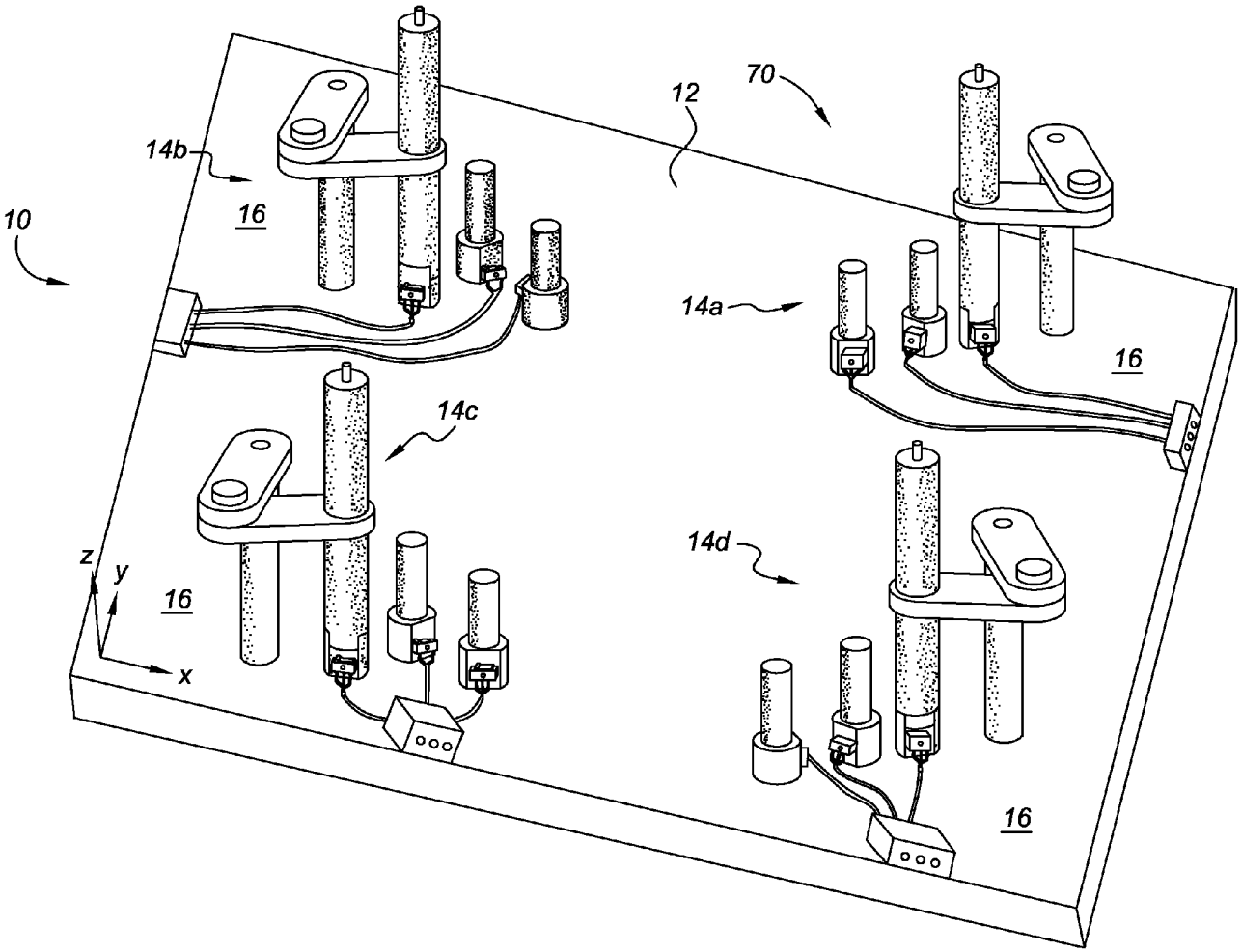
FIG. 1 is a perspective view illustrating a reconfigurable pallet of the present invention.

Referring to the Figures, wherein like reference numbers refer to the same or similar components throughout the several views, FIG. 1 is a perspective view of an exemplary pallet 10 of the present invention.

The pallet 10 includes a platform 12 and a plurality of support assemblies 14 located at multiple positions on the platform 12. As shown, four support assemblies 14*a-d* are located one at each corner 16 of the platform 12. One support assembly 14 is associated with each support location for the component. The number and location of the support assemblies 14 is determined by the design and type of the component to be supported. An x, y and z direction are defined by the pallet 10. Each support assembly 14*a-d* is located at a specific x-y-z coordinate as described below.

Figure 2:
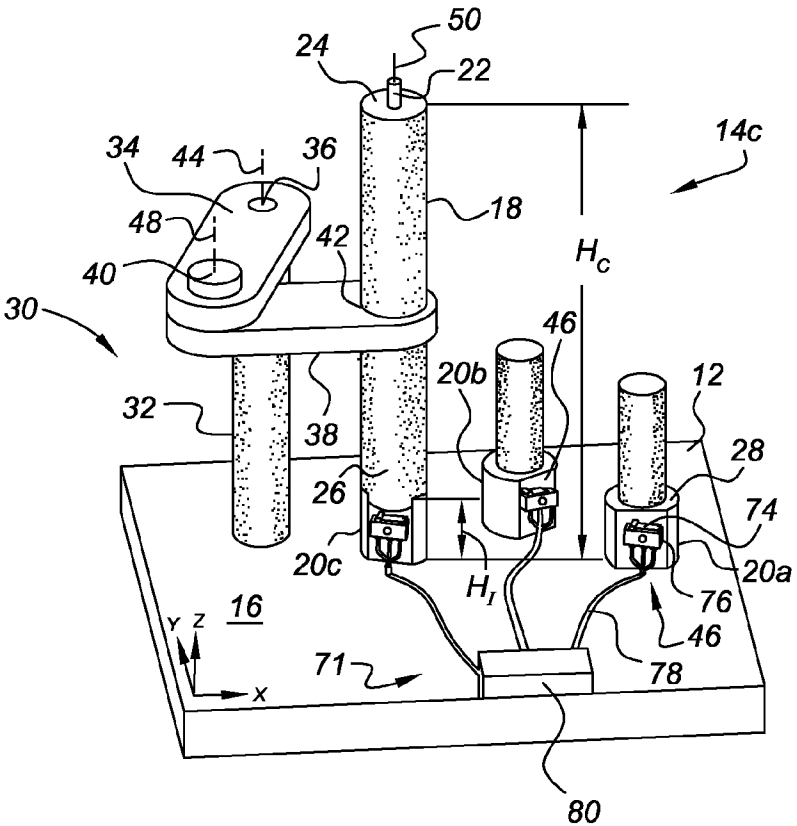
FIG. 2 is an enlarged perspective view of one support assembly for the pallet of the present invention.

FIG. 2 illustrates an enlarged perspective view of one section of the pallet 10 showing one of the support assemblies 14*c*. The other support assemblies 14*a, b* and *d* on the pallet 10 are configured in the same manner as described herein. The support assembly 14*c* includes a support element 18 and a plurality of bases 20. Preferably, there are multiple bases 20, one base for each version of the component to be supported. In the embodiment of FIG. 2, there are three bases 20: a first base 20*a*, a second base 20*b*, and a third base 20*c*. Therefore, the example embodiment is of a pallet 10 for use with a component having three different configurations. For example, the component is an engine and three different engines are available for a vehicle assembled on the assembly line. The pallet 10 can be configured to support each version of the engine. Additional versions of the component can be accommodated by adding another base 20 at the appropriate location for each support assembly 14.

Figure 5:
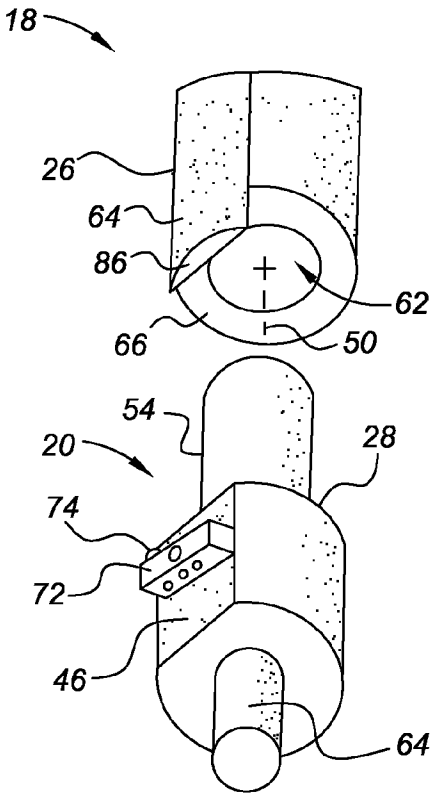
FIG. 5 is a perspective exploded view of one support element and base of the support assembly for the pallet of the present invention.

Referring to FIG. 2 and FIG. 5, the support element 18 includes a locator 22 along an end 24, as shown. The locator 22 corresponds to a predetermined location on the component which has a mount for alignment with the locator 22. The locator 22 is positioned at a specific location and height to correspond to the component mount. In the embodiment shown, the locator 22 is a pin that could correspond to a female receptacle defined by the component at the mount. For example, the component is an engine and a pin receiver is positioned on the engine at the component mount location. Alternately, the locator 22 may be a support plane on the support element 18 that corresponds to a plane on the component at the mount. Other arrangements may be used for the locator 22, such as, a female receptacle defined by the locator 22 and a male coupling on the component at the mount.

The support element 18 is positioned on the desired base 20, in this instance base 20*c*. The support element 18 has a footing 26. The footing 26 couples with the desired base 20*c*. In the embodiment shown, the multiple bases 20*a-c* each have an interface 28 for mating with the footing 26. The interface 28 places the support element 18 in the desired x-y coordinate location. The interface height $H_I$ of the desired base 20*c* places the locator 22 at the appropriate component height $H_C$ for that version of the component. Therefore, each base 20*a-c* is associated with a specific x-y-z coordinate appropriate to the version of the component being supported on the pallet 10 by the base 20*a-c*.

The interface 28 includes an alignment mechanism 46. The alignment mechanism 46 places the support element 18 in the desired rotational alignment for that corresponding base 20, here base 20*c*. The locator 22 may be placed in an eccentric location relative to axis 50 of the support element 18. By providing rotational alignment of the support element 18 the locator 22 may be placed in multiple x-y coordinate positions that are relatively close to one another, as explained with respect to FIGS. 5 and 6*a-c*. The size of bases 20*a-c* may have the same diameter as support element 18 also, to provide multiple x-y coordinate positions that are relatively close to one another.

Each support element 18 is constrained by a linkage assembly 30. The linkage assemblies 30 guide and support the support element 18 and ensure that there are no loose parts associated with the pallet 10 to prevent dropping parts during pallet reconfiguration. However, the support element 18 could be detached from the linkage assembly 30 if so desired. Each linkage assembly 30 has a foundation 32 secured to the platform 12. A first arm 34 is rotatably connected to the foundation 32 with a first joint 36. A second arm 38 is rotatably connected to the first arm 34 with a second joint 40. An aperture 42 for receiving the support element 18 is defined by the second arm 38 and is positioned remotely from the second joint 40. The support element 18 can freely rotate and slide in the z direction when located within the aperture 42.

The first joint 36 rotatably connects the first arm 34 to the foundation 32. The first arm 34 rotates about a first axis 44 that is oriented in the z direction. The second joint 40 rotatably connects the second arm 38 with the first arm 34. The second arm 38 rotates about a second axis 48 that is also oriented in the z direction, and is parallel to the first axis 44. The x-y coordinate location of the second axis 48 may be changed by rotating the first arm 34 about the first axis 44. Once the support element is mounted on the interface 28 rotation of the first arm 34 about the first axis 44 and the second arm 38 about the second axis 48 is prevented. This prevents movement of the first arm 34 and the second arm 38 relative to the foundation 32 and thus, to the platform 12.

The support element 18 rotates within the aperture 42 about a third axis 50 that is oriented in the z-direction and parallel to the first and second axes 44 and 48. The x-y coordinate location of the third axis 50 may be changed by rotating the second arm 38 about the second axis 48 when the support element 18 is not received within the interface 28. Once the footing 26 is received by the interface 28, the x-y coordinate location of the third axis 50 is fixed. Gravity and weight of the component restrict the support element 18 from moving along the third axis 50 during pallet 10 usage.

To configure the support assembly 14*c* for another version of the component the footing 26 is moved from the interface 28 of base 20*c* to the interface 28 of base 20*a* or 20*b*, as desired, and the support element 18 is moved within aperture 42 for vertical adjustment.

To reconfigure the entire pallet 10 this is repeated for each of the support assemblies 14*a-d* located on the pallet 10. To ensure proper positioning of the support element 18 for each of the support assemblies 14*a-d* the bases 20 may be colored or numbered alike for each version of the component. That is, base 20*a* of support assembly 14*c* has a matching color to a similar base 20*a* of each of the support assemblies 14*a, b* and *d* on the pallet 10. Base 20*b* of support assembly 14*c* would have another color matching each similar base 20*b* of each of the support assemblies 14*a,b* and *d* and base 20*c* of support assembly 14*c* would have a third color matching each similar base 20*c* of each of the support assemblies 14*a, b* and *d*. Positioning the footings 26 for each support assembly 14*a-d* with similarly colored bases 20 to one another would ensure that the locators 22 are in the proper location for each version of the component. For example, the component is an engine and each version of the engine would have a color associated therewith. All of the bases 20 utilized to support that engine version would be the associated color.

In addition to coloring the bases 20 to ensure proper positioning of the support element 18, an error proofing system 70 may be associated with each support assembly 14*a-d*. The error proofing system 70 provides an indication showing when the support element 18 is in the proper base 20*a-c* and may also provide an indication of the appropriate remedial action to be taken if the support element is in an improper base 20*a-c*. The error proofing mechanism includes a power source, sensors, a communication device and, optionally, a controller associated with each platform 12. More specifically, each base 20 and support element 18 will incorporate at least one sensor. The power source, not shown on the figures for clarity, may be mounted directly on platform 12 as for example a battery, or may be remotely located and the power transmitted to platform 12 and the error-proofing system 70 specifically by either contact, for example mating complementary male-female connectors, or non-contact means, for example inductive coupling. A wide range of sensors may be used provided they are capable of determining whether or not a specific support element 18 is mounted on its appropriate base 20*a-c*. Examples, without limitation, include a mechanically-activated switch; magnetic sensors such as Hall effect sensors, or proximity sensors; and optical sensors, either transmissive or reflective. Depending on the choice of sensor and the nature of the output from that sensor, a controller may be required to interface with a communication device capable of providing an operator with information regarding the state of the platform 12 and, more specifically whether the support element 18 and the base 20*a-c* combinations created on the platform constitute a self-consistent set. In other words are the bases 20*a-c* all part of the same subset so that all support elements 18 on the platform are attached to their respective base 20*a* or to their respective base 20*b* or to their respective base 20*c* or is one support attached to a different base 20*a-c*. If required, the role of the controller will be to transform the sensor signal into a signal compatible with the requirements of the communication device. The communication device may provide: a visual indication, for example a light emitting diode or a plurality of light emitting diodes; an aural indication, for example a buzzer or loudspeaker; a tactile indication, for example a vibratory stimulus; or any combination of these. Similarly, the communication device may indicate the current status of the platform 12 or, if the platform 12 is inappropriately configured, it may also suggest corrective action. In the specific embodiment illustrated in FIGS. 7 and 8, the sensor is a switch mounted on surface 54 such that it will be contacted by and operated by contact of the surface 86 of the elongated portion 64 of support element 18. The contact mechanism 72 has wires 78 connecting the contact mechanism 72 with a control unit 80. Further operation of the error proofing system 70 shown is explained below.

The bases 20*a-c* for each support assembly 14*a-d* may have different interface heights $H_I$ than one another. That is, the interface height $H_I$ for the base 20*a* of the support assembly 14*a* may differ from the interface height of the base 20*a* of the support assembly 14*b* which differs from the interface height of the base 20*a* of the support assemblies 14*c* and 14*d*. Alternatively, all the bases 20*a-c* may be the same height and shims located between the base 20*a-c* and the platform 12 can be used to adjust the interface height $H_I$ for each base 20*a-c*. The interface height $H_I$ for the bases 20*a-c* is determined by the component mount requirement at each support assembly 14*a-d* location for that version of the component.

Figure 3:
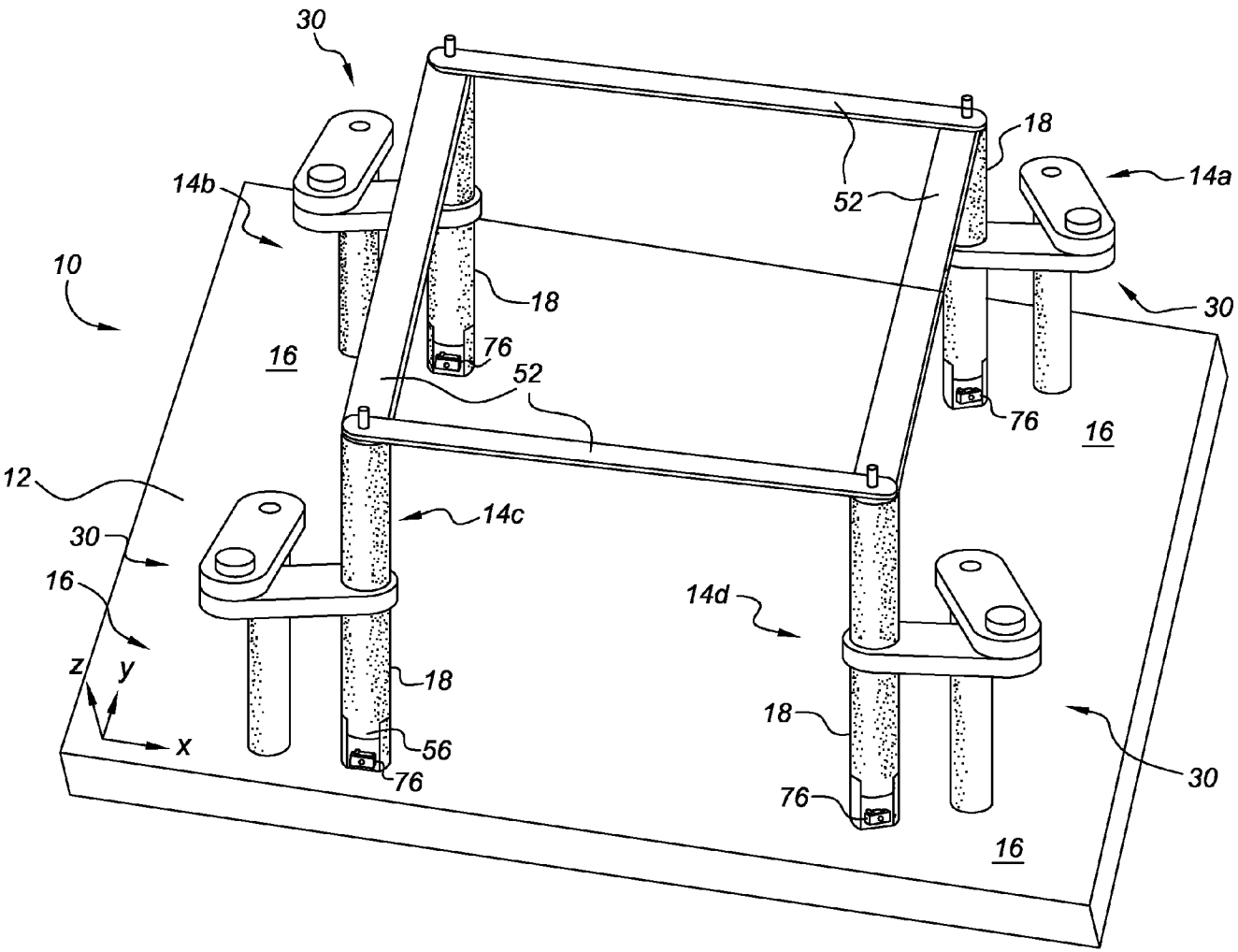
FIG. 3 is a perspective view illustrating the reconfigurable pallet of the present invention supporting a component.

FIG. 3 illustrates support of one version of a component on the pallet 10. The support elements 18 and bases 20*c* for the one version of the component are shown. The remaining bases 20*a, b* and *d* of the support assemblies 14*a-d* are removed for simplicity. The component to be supported is represented by rigid links 52. Each interface 28 has an extension 54 (shown in FIGS. 4 and 5) and a wall 56. The wall 56 of the interface 28 aligns the support element 18 and the footing 26 with the base 20*c*. The extension 54 assists in aligning the support element 18 and the footing 26 and absorbs lateral forces, in the x or y direction, caused by the component during movement of the pallet 10.

Figure 4:
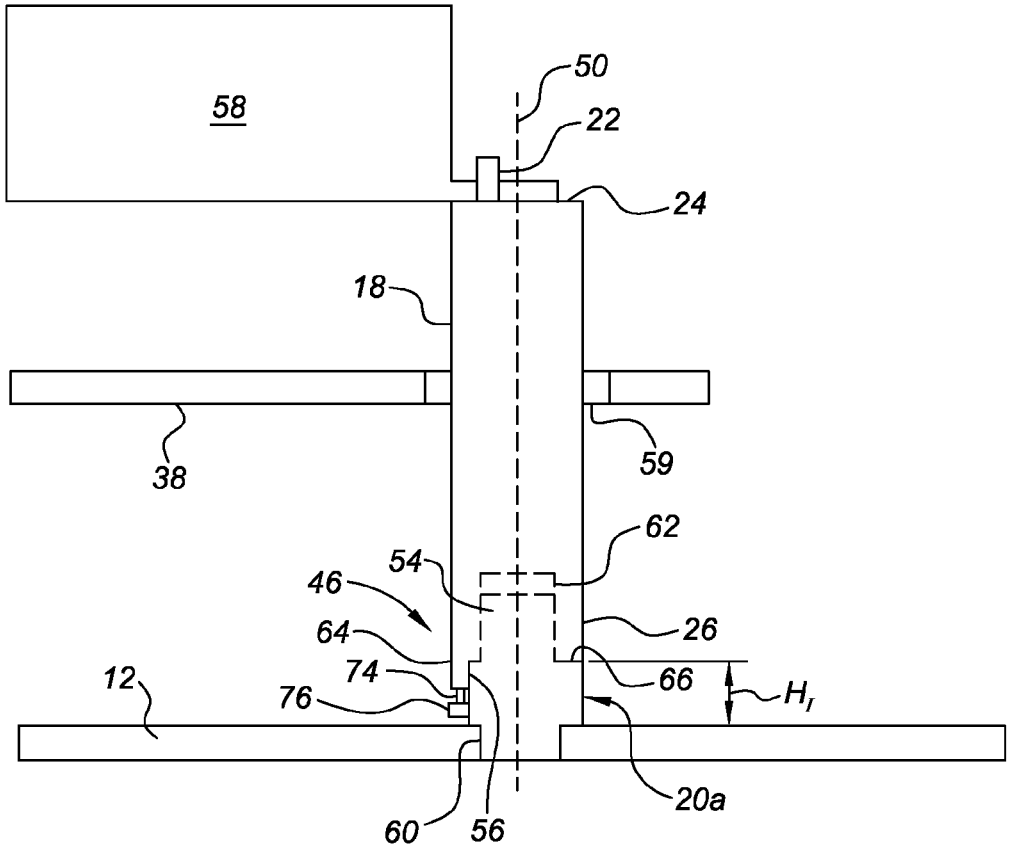
FIG. 4 is a side view of one support element located in a base of the support assembly for the pallet of the present invention.

FIG. 4 is a side view of one support element 18 located in a base 20*a*. The component is represent by an element 58 mounted on the locator 22. The base 20*a* is secured to the platform 12 with a press fit between the platform 12 and a fitting portion 60 such as by a serrated surface. The footing 26 of support element 18 defines a recess 62. The extension 54 of base 20*a* is received within the recess 62 of the support element 18. The footing 26 and extension 54 assist in absorbing lateral forces acting on the support element 18 by element 58. The second arm 38 of the linkage assembly 30 supports the support element 18. A bushing 59 may be located between the support element 18 and the second arm 38. The bushing 59 provides support to and allows rotational and vertical movement of the support element 18. Once the support element 18 is located on the base 20*a* the alignment mechanism 46 and the component 58 prevent rotational and vertical movement of the support element 18.

FIG. 5 is an exploded perspective view of the base 20 and the support element 18 illustrating the alignment mechanism 46. In addition to defining the recess 62 the footing 26 includes an elongated portion 64. The elongated portion 64 extends beyond an end 66 of the support element 18. When the extension 54 is received within the recess 62 the elongated portion 64 must align with the wall 56 of the base 20*a* to fully seat the support element 18 on the base 20*a*. The support element 18 can be rotated within aperture 42 (shown in FIG. 2) until the elongated portion 64 and wall 56 are in rotational alignment with one another.

The alignment mechanism 46 defines an extension 54 located on the base 20 and a recess 62 defined by the footing 26 of the support element 18. Alternatively, the support element 18 could define an extension including a planar wall and the base 20 could define a recess having a flat interior surface to align with the planar wall of the support element 18.

Figure 6B:
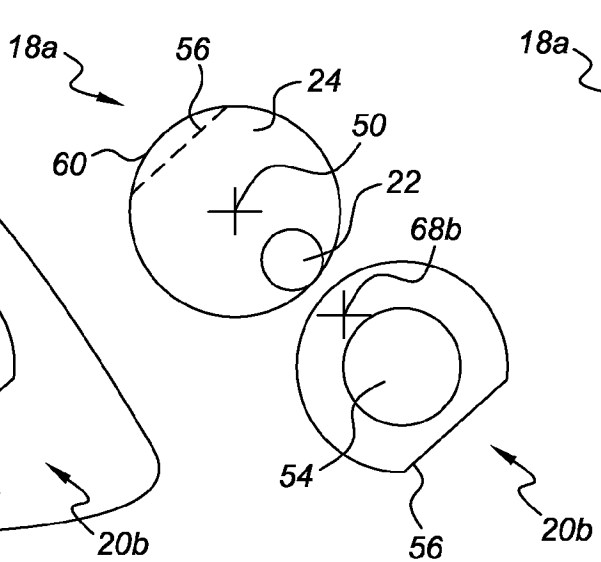
Figure 6A:
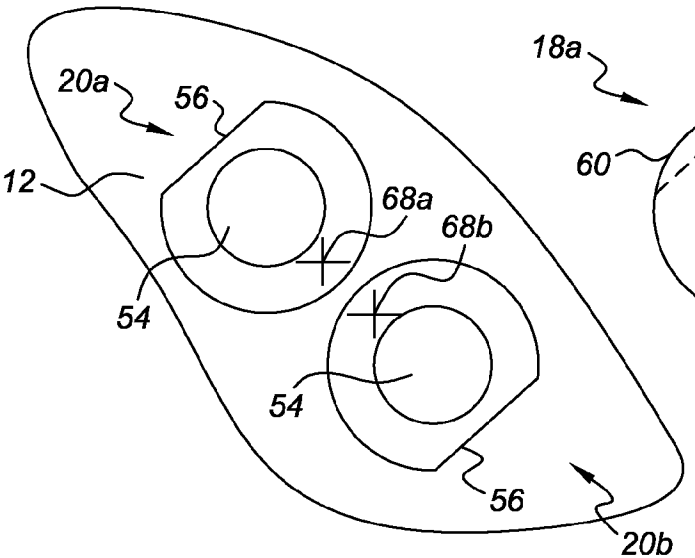

FIGS. 6*a*-6*c* illustrate the alignment of the footing 26 and the interface 28 to position the locator 22. FIG. 6*a* is a top view of the first base 20*a* and the second base 20*b* from one of the support assemblies 14. Desired mounting position 68*a* for a first version of the component and desired mounting position 68*b* for a second version of the component are indicated. The x-y coordinate distance between the desired mounting positions 68*a* and 68*b* is less then the distance from the center of the base 20*a* to the center of the base 20*b*. Thus, to get the locator 22 in the desired position the locator 22 must be positioned eccentric from the third axis 50 of the support element 18. A mechanism for positioning the locator 22 and the support element 18 in the correct rotational position relative to the base 20 is required. Aligning the elongated portion 64 on the support element 18 and the wall 56 on the base 20 allows the rotational position of the support element and the locator 22 to be set. When mounting the bases 20*a* and 20*b* to the platform 12 the walls 56 are oriented based upon the desired mounting positions 68*a-b* and the position of the locator 22 relative to the center of support element 18. Thus, by facing the walls 56 away from each other on a pair of bases 20*a* and 20*b*, two close points of support for the component may be provided.

FIG. 6*b* is a top view of the base 20*b* and the support element 18 positioned on base 20*a*. The locator 22 has an off-center location with respect to the support element 18. That is, the locator 22 is eccentrically located from the third axis 50 about which the support element 18 rotates. By aligning the elongated portion 64 with wall 56 the locator is rotated to the same position as the desired mounting position 68*a* (shown in FIG. 6*a*). Correspondingly, FIG. 6*c* is a top view of the base 20*a* and the support element 18 positioned on base 20*b*. The platform is, thus, configured to support a different version of the component. The locator 22 has the same eccentric location with respect to the third axis 50 of the support element 18 as shown in FIG. 6*b*. However, the support element 18 has been rotated to align the elongated portion 64 with wall 56 placing the locator 22 in the desired mounting position 68*b* (shown in FIG. 6*a*).

FIG. 7 illustrates one support assembly 14 equipped with an error proofing mechanism 71 of the error proofing system 70. Each base 20*a-c* of the support assembly 14 has a contact mechanism 72 mounted thereon. The contact mechanism 72 includes a contact area 74 and a relay device 76. The relay device 76 has wires 78 connecting the contact mechanism 72 with the display unit 80. Preferably, one display unit 80 is associated with each support assembly 14, as shown. Alternatively, the pallet 10 may have one display unit 80 connected to the contact mechanisms 72 of all of the support assemblies 14*a-d*.

A series of display indicators 82*a, b, c* is provided wherein the letter indices (a, b or c) for the display lights correspond to the similarly indexed base 20 *a-c*. For example illumination of display indicator 82*a* would correspond to closure of contact mechanism 72 on base 20*a*. The display indicators 82*a-c* may be mounted individually on either the respective switch 76 or base 20*a* or indicators from all bases 20*a-c* may be displayed in a common location, display unit 80.

Once the support element 18 is mounted on the base 20 one of the display indicators 82 is activated. The display indicators 82*a, b, c* are preferably light emitting diodes (LEDs) but any active display including incandescent lights, liquid crystal displays (LCDs) and electro-luminescent displays may be used without restriction. The LEDs are preferably multi-colored, each color being associated with one base 20 *a, b* or *c* and thereby to one version of a component to be supported by the pallet 10. In this embodiment when one of the support elements 18 is mounted to an incorrect base 20 a display indicator 82*a-c* of different color than the other bases 20*a-c* would be illuminated. This mismatch between the color of the display indicators 82*a-c* would indicate to an operator that an at least one of the support elements 18 had been placed on an incorrect base 20*a-c* and the one to one correspondence of a particular display indicator 82*a-c* with a particular support assembly 14 would easily enable the operator to identify the incorrect support assembly 14 and take remedial action. Providing an indication of the correct base 20 would save the operator time from having to determine which base 20*a-c* is proper, or where the error is occurring.

An electrical circuit 90 to enable this embodiment is shown in FIG. 9 and comprises a series of independent circuits 92 each connected to a common power source 94. Each independent circuit 92 comprises a series of display indicators, 82*a-c*, here shown as lamps, connected in parallel and each controlled by an individual switch 77 which is part of the relay device 76 (shown in FIG. 7). Placement of the support element 18 on the base 20*a-c* will close switch 77 corresponding to that particular base 20*a-c* and will result in activating the respective display indicator 82*a-c*. For the circuit 90 shown, this would correspond to illuminating the respective indicator 82*a-c*.

FIG. 10 illustrates an alternative electrical circuit 96 of the embodiment illustrated in FIG. 7 an arranged in series. The electrical circuit 96 includes a common power source 98. The electrical circuit 96 comprises a series of display indicators, 82*a-c*, here shown as lamps, connected in parallel and each controlled by an individual switch 77 which is part of the relay device 76 (shown in FIG. 7), Each of the display indicators 82*a-c* is arranged in series. This reduces the overall amount of wiring required for the electrical circuit 96.

FIG. 11 shows another embodiment of a circuit 100 which requires fewer display resources. Specifically using the circuit 100 of FIG. 11 enables the operator to determine whether or not all support elements 18 are correctly placed on their appropriate bases 20*a-c*. The electrical circuit 100 includes a common power source 106. The circuit 100 comprises a number of parallel circuits 102, one each for each of the number of bases 20*a-c* in a given set, here three corresponding to the variants 20*a*, 20*b* and 20*c*. Within these parallel circuits 102 the switches 104 corresponding to each of the base families, here a, b and c, are connected serially so that if any support is placed on an improper base 20*a-c* the circuit 102 will not be completed and the display indicators 82*a-c*, preferably LEDs, will not illuminate alerting the operator that the support assembly 14 configuration was incorrect. Visual inspection of the platform 12 would be required to identify the mis-matched support assembly 14. The circuit 100 as shown also indicates which of the variants of the bases 20*a-c* is configured since each variant is assigned an individual display device. However if the only information required is that a variant is appropriately configured a single display indicator 82 may be used as shown the electrical circuit of 100*a* shown in FIG. 12.

Note that the embodiment of FIG. 12 could be simply modified or expanded for display indicator 82 to create an aural indication by modifying the completed circuit 100*a* so that it generates a tone, or optionally, a recording playable through a loudspeaker.

FIG. 8*a* and FIG. 8*b* illustrate assembly of the support element 18 with the error proofing mechanism 70. The contact surface 86 on the elongated portion 60 contacts the contact area 74 when the support element 18 is assembled onto the base 20. The contact mechanism 72 is mounted on the wall 54 of the base 20. This ensures that the contact surface 86 will be in rotational alignment with the contact mechanism 72 when the support element 18 is assembled on the base 20. The contact mechanism 72 may be activated by pressure of the contact surface 86 acting on the contact area 74. Alternatively, the contact surface 86 of the support element 18 may include a coating or material that is electrically conductive. Contact with the contact area 74 may close a circuit to activate the error proofing mechanism 70. Wires 78 relay the signal to the control unit 80 for processing. Additionally, wires 78 provide electrical power from the control unit 80 to the contact mechanism 72. A battery may be incorporated into the control unit 80 or mounted to the platform 12 at an adjacent location to provide the required power source.

In the above embodiments an example of the component to be supported is an engine. This is in no way meant to be restrictive and other components may be utilized with the reconfigurable pallet of the present invention.

While the best modes for carrying out the invention have been described in detail, those familiar with the art to which this invention relates will recognize various alternative designs and embodiments for practicing the invention within the scope of the appended claims.

The invention claimed is:

1. A support assembly for a reconfigurable pallet comprising:

a linkage assembly mounted to a platform;

a support element rotatably and slideably mounted to the linkage assembly;

wherein the linkage assembly includes a foundation secured to the platform, a first arm rotatably connected to the foundation and a second arm rotatably connected to the first arm, wherein the second arm defines an aperture to slideably and rotatably receive the support element;

a plurality of bases for selectively receiving the support element;

an alignment mechanism associated with each base to align the rotational position of the support element relative to the base; and an error proofing mechanism associated with the support assembly to ensure the support element is selectively received on a desired one of the plurality of bases.

2. The support assembly of claim 1, wherein the support element further comprises a locator positioned at a first end, a footing positioned at a second end, wherein the footing defines a recess, and an elongated portion extending from the footing beyond the second end wherein a contact surface is located on the elongated portion.

3. The support assembly of claim 2, wherein the plurality of bases each comprise an extension extending vertically, the extension to be received by the recess in the footing of the support element, and wherein the extension is at a predetermined height corresponding to a desired height for the locator.

4. The support assembly of claim 3, wherein the alignment mechanism comprises a planar wall located on one side of each of the plurality of bases.

5. The support assembly of claim 4, wherein the error proofing mechanism further comprises a contact mechanism, including a relay device mounted on the planar wall of each of the plurality of bases and a contact area located on the relay device.

6. The support assembly of claim 5, wherein the wall is aligned with the elongated portion prior to the extension being received within the recess such that the contact area of the relay device is aligned with the contact surface of the support element.

* * * * *